US006457423B1

(12) United States Patent
Gordon

(10) Patent No.: US 6,457,423 B1
(45) Date of Patent: Oct. 1, 2002

(54) TRAY COVER

(76) Inventor: Bonnie M. Gordon, 7101 Burlington Rd., Whitsett, NC (US) 27377

( * ) Notice: Subject to any disclaimer, the term of this patent is extended or adjusted under 35 U.S.C. 154(b) by 0 days.

(21) Appl. No.: 09/666,680

(22) Filed: Sep. 21, 2000

(51) Int. Cl.[7] ..... A47B 13/08
(52) U.S. Cl. ..... 108/90
(58) Field of Search ..... 108/90; 150/158

(56) References Cited

U.S. PATENT DOCUMENTS

| | | | | | |
|---|---|---|---|---|---|
| 1,142,571 | A | * | 6/1915 | Hoffberg | 108/90 |
| 1,332,776 | A | * | 3/1920 | Sultanaki | 108/90 X |
| 1,587,387 | A | * | 6/1926 | Lichtman | 108/90 X |
| D103,918 | S | | 3/1937 | Traum | |
| 3,153,505 | A | | 10/1964 | Bessett | |
| 3,279,515 | A | * | 10/1966 | Kesh | 108/90 |
| 3,295,577 | A | * | 1/1967 | Danielson | 108/90 X |
| 3,368,601 | A | * | 2/1968 | Gantert-Merz | 108/90 |
| 3,428,167 | A | | 2/1969 | Sheng | |
| 3,729,037 | A | | 4/1973 | Dare et al. | |
| 3,763,907 | A | | 10/1973 | Hockley et al. | |
| D261,210 | S | | 10/1981 | Capanear | |
| 4,691,955 | A | | 9/1987 | Pousar | |
| 5,165,633 | A | | 11/1992 | Effa et al. | |
| 5,240,758 | A | | 8/1993 | Honigberg | |
| 5,339,748 | A | * | 8/1994 | Bilotti | 108/90 |
| 5,462,103 | A | | 10/1995 | Effa | |
| 5,727,477 | A | | 3/1998 | Kirkendall | |
| D417,999 | S | | 12/1999 | Ingram | |

* cited by examiner

*Primary Examiner*—Jose V. Chen
(74) *Attorney, Agent, or Firm*—Womble Carlyle Sandridge & Rice, PLLC

(57) ABSTRACT

A cover for the planar surfaces of oval-shaped food service trays of the type used in the restaurant and food service industry including an oval-shaped fabric panel with a pattern formed on at least one surface of the fabric panel to facilitate the proper placement of the fabric panel over the tray. Alternatively, an elastic material may be attached to the fabric panel to facilitate proper placement of the fabric panel and to prevent the fabric panel from slipping from the tray.

4 Claims, 2 Drawing Sheets

TRAY COVER

FIELD OF THE INVENTION

The present invention relates generally to accessories for use in the food service industry and, more particularly, to covers for the oval-type food service trays.

BACKGROUND OF THE INVENTION

It is well known that the food service industry is very competitive, with many startup restaurants and clubs failing within the first year of business. Accordingly, cost control is critical to maintaining overhead and operating costs in check. The initial outlay of capital for food service equipment and supplies can be substantial, forcing restaurant owners and the like to purchase equipment and materials with long service lives. Most equipment is centered in the kitchen area and never seen by restaurant and club patrons, so appearance is not important. However, certain items such as dinnerware and service trays are quite visible to customers and must be aesthetically pleasing so as to convey a positive impression of quality and service. Since these items receive such heavy usage, their outer appearances diminish rapidly, even though they may remain serviceable for a much longer time. For example, service trays become chipped and scarred, and the flat surfaces become marred and dull. The cork surfaces of cork-lined trays cut and chip easily, leaving them quite unsightly.

There are known in the art disposable paper and plastic place mats for lunchroom trays and childrens' high chairs that provide for quick clean-up, but these are not intended to be aesthetically pleasing. They are intended instead for quick service, fast food type establishments where aesthetic factors are not as important. Further, they are typically used for rectangular surfaces and not for larger oval or oblong-shaped service trays. Linen napkins or folded tablecloths are often used to cover the unsightly surfaces of trays where the trays are used in a static configuration such as in a buffet line. However, the folding and placement of full size table covers for use on trays is both time consuming and expensive.

SUMMARY OF THE INVENTION

The present invention is directed to an attractive fabric cover having a more formal appearance for the planar surfaces of oval-shaped food service trays of the type used in the restaurant and food service industry. The cover may have a pattern formed on at least one of the cover surfaces where the pattern extends parallel to the major axis of the fabric, thus facilitating the proper placement of the fabric panel on the food service tray. The cover may further include elastic thread, cord, or a fabric band attached around a peripheral edge. When the fabric panel is positioned so that the elastic band conforms to the shape of the food service tray, the band facilitates the quick and proper placement of the fabric panel on the tray.

Accordingly, one aspect of the present invention is to provide a cover for the planar surfaces of oval-shaped food service trays having an oval-shaped fabric panel with a pattern formed therein. The fabric panel is desirably of a woven construction and formed of stain-resistant yarns such as 100% polyester. Other suitable woven, non-woven, or knitted fabric panels formed of stain-resistant yarns or fibers may also be used in constructing the fabric panel. Desirably, the fabric panel is larger than the planar surface of the food service tray, thus enabling the fabric panel to hang over the edge of the planar surface to form a skirt portion. This greatly enhances the aesthetic appearance of the food service tray and cover combination, essentially hiding any worn and unsightly features of the tray itself.

The oval-shaped fabric panel is formed in such a manner as to have a long or major axis, whereby the major axis aligns with the major axis of a food service tray. The fabric panel has a first, or top surface, a second, or bottom surface, and a peripheral edge portion that is desirably formed on the edge such that the fabric panel is reversible. Since conventional oval service trays are approximately 20" wide×25" long or 23" wide×27" long, properly positioning a cover over a tray is difficult, particularly tedious, and time consuming when a number of trays must be covered. Thus, a pattern such as a stripe-on-stripe, is formed on at least one of the fabric panel surfaces such that the pattern visibly extends parallel to the major axis of the panel. A variety of different patterns may be used as long as the orientation of the pattern extends parallel to the major axis of the fabric panel. Formed in this manner, when the fabric panel is positioned with the pattern parallel to the major axis of the food service tray, the pattern facilitates the quick and proper placement of the oval-shaped fabric panel over the tray.

A further aspect to the present embodiment is to include a band or cord of elastic material that may be attached to at least one of the surfaces of the fabric panel, where the band of elastic is spaced apart from and runs parallel to the peripheral edge of the fabric panel for gripping the edge, or lip, of the planar surface of the food service tray. This prevents the cover from sliding out of the correct orientation with respect to the tray during use and ensures that the cover will not slip off of the tray should the tray be tilted, or blown when used outdoors. The elastic material may be elastic thread, elastic cord, or an elastic fabric band. Alternatively, an elastic thread, cord, or band may be sewn into or otherwise formed in the edge, or hem portion, of the fabric panel to create a gather. As used herein, "gather" refers to small folds or puckers created when an elastic material is pulled through, sewn in, or formed in a fabric. This also serves to prevent the cover from sliding from the tray during use, while adding a decorative aspect to the cover.

A second embodiment of the present invention provides a cover for the planar surfaces of oval-shaped food service trays including an oval-shaped fabric panel having a first surface and a second surface, a peripheral edge portion, and a band of elastic material attached to the fabric panel. The band of elastic material is spaced apart and parallel to the fabric panel peripheral edge. As in the first embodiment, the elastic material may be in the form of an elastic band, cord, or thread. The elastic material conforms generally to the shape of the oval fabric panel and is attached to the fabric panel so that it will fit over the edge, or lip, of an oval tray. When the fabric panel is positioned to conform to the shape of the food service tray, the elastic facilitates the proper placement of the fabric panel over the tray and prevents it from slipping off. Since the elastic material conforms generally to the shape of the tray, it is not necessary to have any particular pattern or any other indicia formed in or on the fabric panel to facilitate the proper placement of the cover on the tray. It will not fit the tray in any other orientation. As in the first embodiment, the elastic material also functions to grip the edge of the tray such that the cover does not shift or slip.

These and other aspects of the present invention will become apparent to those skilled in the art after a reading of the following description of the preferred embodiment when considered with the drawings.

DESCRIPTION OF THE PREFERRED EMBODIMENTS

Figure 1:
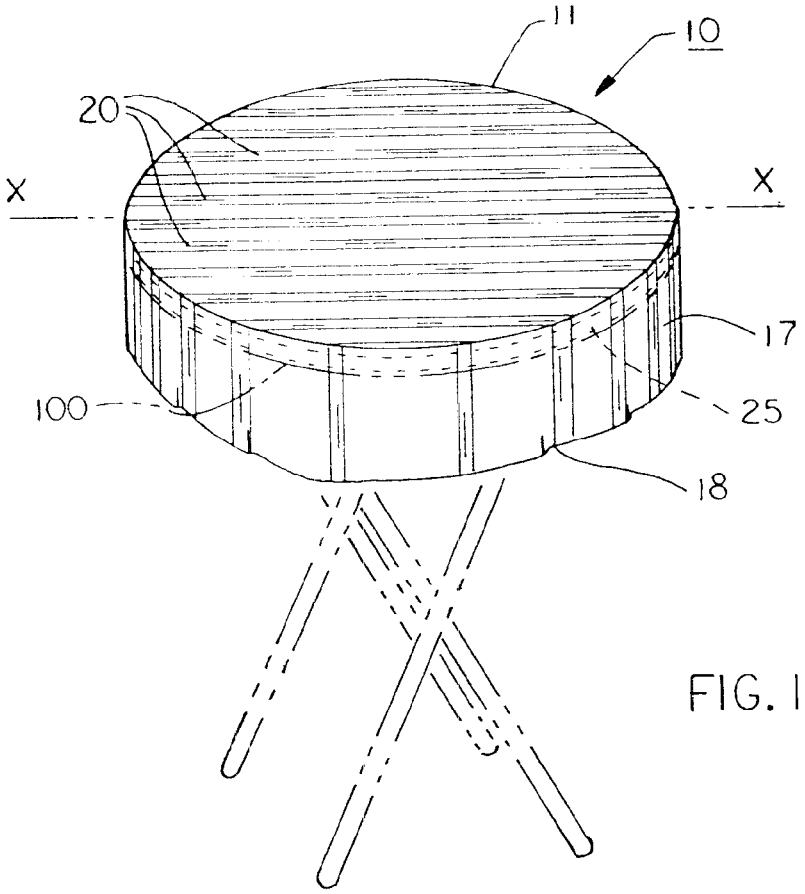
FIG. 1 is an environmental top perspective view of the tray cover according to the present invention positioned on an oval food service tray and stand.
Figure 2:
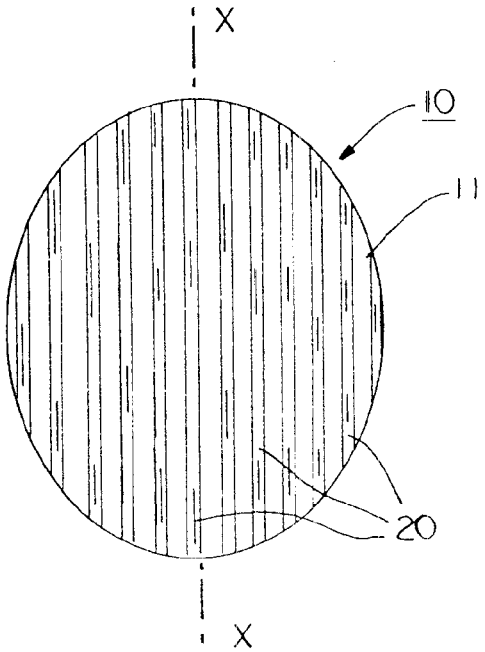
FIG. 2 is a top view of the tray cover of FIG. 1 constructed according to the present invention, showing a first, or top, surface.

Referring now to the drawings in general and FIGS. 1 and 2 in particular, it will be understood that the illustrations are for the purpose of describing a preferred embodiment of the invention and are not intended to limit the invention thereto. As best seen in FIG. 1, a tray cover, generally designated 10, is shown according to the present invention. Tray cover 10 includes an oval-shaped fabric panel 11 having a pattern 20 formed therein. The fabric panel 11 has a peripheral edge portion 18.

Desirably, fabric panel 11 is formed as a woven construction of stain resistant yarns such as 100% polyester so that its useful service between cleanings may be prolonged and such that its overall appearance will not become dull and unsightly over its intended service life. However, other suitable stain resistant materials may be readily substituted.

Because of its oval-shape, fabric panel 11 has a major axis, generally shown by line X—X, along its symmetrical longer dimension. Pattern 20 is formed on at least one surface, extending generally parallel to the major axis. Pattern 20 is preferably a striped pattern; however, any pattern having an orientation visibly parallel to the major axis or that otherwise facilitates proper placement of panel 11 is satisfactory for the purposes described herein. Because of its relatively simple and inexpensive construction, fabric panel 11 may be easily formed using any of the conventional weaving methods such as shuttle, air, water, projectile, rapier, etc. The fabric panel 11 further includes a peripheral edge portion 18 having a marrowed finish. The term "marrowed," as used herein, means that the edges are evenly or equally stitched without any hems so that the fabric article is reversible. One such fabric panel 11 is available from James G. Hardy & Co. as Item No. 6302.53, and is formed as a 50×73 construction (50 weft yams by 73 warp yarns).

As best seen in FIG. 1, fabric panel 11 is sized to be larger than the planar surface of the food service tray 100 that it is intended for use thereon, so that fabric panel 11 is capable of hanging over the edge of tray 100 to form a skirt portion 17 around the periphery of the tray. Skirt portion 17 is desirably 4" to 6" wide, serving to conceal the top and side features of the tray 100 without hindering servers from handling the tray. Because of the oval-shapes of both conventional tray 100 and fabric panel 11, it would be easy to place a plain (no pattern) fabric panel 11, such as that shown in FIGS. 3 and 4, on tray 100 improperly, i.e., either crooked or with the major axis of the panel 11 positioned along the minor axis of tray 100. Thus, pattern 20 formed in fabric panel 11 serves the important function of facilitating the proper placement of fabric panel 11 on tray 100. Simply, when fabric panel 11 is positioned with pattern 20 aligned parallel to the major axis of food service tray 100, fabric panel 11 may be quickly and properly placed in the correct axial alignment over tray 100.

Figure 4:
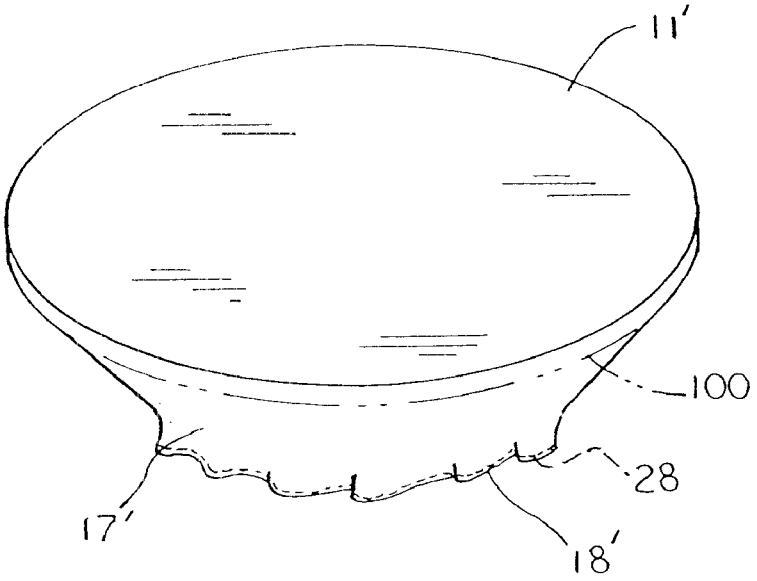
FIG. 4 is a top perspective view of the tray cover of FIG. 1 showing an alternative placement of elastic material in the tray cover peripheral edge.

To prevent panel 11 from slipping out of place or off of tray 100, an oval-shaped band or cord of elastic 25 conforming in shape to panel 11, but larger than the oval shape of tray 100, is attached to skirt portion 17. The band or cord 25 is sized and situated on skirt portion 17 so that it can grip underneath the outer edge, or lip, of tray 100 and hold panel 11 tautly over the planar surface of tray 100. Desirably, for functionality as well as aesthetic purposes, band or cord 25 should be spaced outward from the edge of tray 100 by at least about 1 inch. The elastic band or cord 25 may be formed from any conventional elastomeric material and is desirably the same color as fabric panel 11. Further, elastic fabric may be attached to both sides of fabric panel 11 so that the fabric panel may be reversibly used. Alternatively, or in addition to band or cord 25, and as shown in FIG. 4, panel 11' may include a cord or thread of elastic 28, sewn in, pulled through, or otherwise formed in the edge 18' to form a gather. The gather serves to prevent the cover from sliding from the tray during use, while adding a decorative aspect to the cover.

Figure 3:
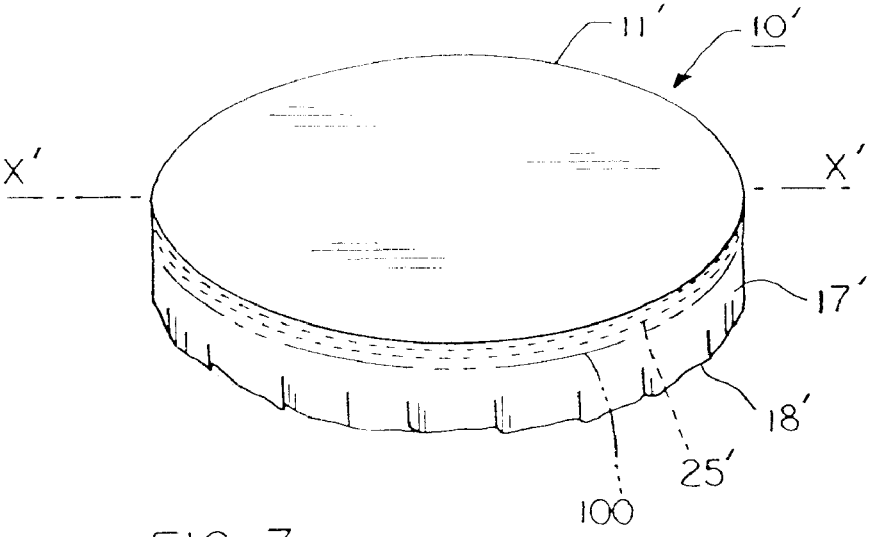
FIG. 3 is a top perspective view of an alternative embodiment of the tray cover positioned on an oval food service tray.

As shown in FIG. 3, a further embodiment of the present invention is a cover 10' for food service trays 100 having an oval-shaped fabric panel 11' without any particular pattern or other indicia aligned thereon. Fabric panel 11' is desirably of a woven construction similar to fabric panel 11 and also formed of stain resistant yarns such as 100% polyester. A band or cord of elastic material 25' is attached in similar fashion to fabric panel 11 so that the fabric panel 11' may be reversible and is capable of gripping the outer edge of tray 100. Because the elastic 25' conforms in shape to and runs parallel to edge portion 18', the elastic band or cord 25' forms an oval-shaped arrangement slightly larger than the size of the planar surface of tray 100. Thus, when fabric panel 11' is positioned with the elastic band or cord 25' conforming to the oval-shaped tray 100, the band or cord 25' both facilitates the proper placement of fabric panel 11' thereover and prevents any other orientation. This combination of fabric panel 11' and the elastic band or cord 25' permits fabric panel 11' to be placed only with the major axis of fabric panel 11' in parallel alignment to the major axis (X'—X') of tray 100. Accordingly, the user may select any pattern for fabric panel 11', or simply no pattern at all.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A cover for oval-shaped food service trays of the type used in the restaurant and food service industry comprising:

(a) an oval-shaped fabric panel larger than the oval-shape of a food service tray and having a major axis, at least one surface of said panel having a striped pattern formed therein, the stripes of said pattern extending parallel to the major axis of said fabric panel; and (b) whereby said striped pattern facilitates the proper placement of said oval-shaped fabric panel on said food service tray and said fabric panel extends loosely over the edge of said food service tray to form a skirt portion.

2. The cover of claim 1 further including an oval-shaped band of elastic fabric conforming in shape to said fabric panel and attached to said skirt portion for gripping the edge of said food service tray and preventing the slippage of said fabric panel therefrom.

3. The cover of claim 1 further including an elastic thread sewn or formed in said peripheral edge portion for preventing the slippage of said fabric panel from said food service tray.

4. The cover of claim 1 wherein said fabric panel is reversible.

* * * * *